US008539708B2

(12) United States Patent
Kenney et al.

(10) Patent No.: US 8,539,708 B2
(45) Date of Patent: Sep. 24, 2013

(54) BARREL MOUNTING AND RETENTION MECHANISM

(75) Inventors: Daniel E. Kenney, Elizabethtown, KY (US); James W. Ronkainen, Hodgenville, KY (US); David O. Matteson, Horse Cave, KY (US); Luke T. Wilkinson, Cecilia, KY (US)

(73) Assignee: RA Brands, L.L.C., Madison, NC (US)

( * ) Notice: Subject to any disclaimer, the term of this patent is extended or adjusted under 35 U.S.C. 154(b) by 105 days.

(21) Appl. No.: 13/155,117

(22) Filed: Jun. 7, 2011

(65) Prior Publication Data

US 2012/0311908 A1 Dec. 13, 2012

(51) Int. Cl.
*F41A 21/00* (2006.01)

(52) U.S. Cl.
USPC ..... 42/75.02; 42/75.01; 42/75.03

(58) Field of Classification Search
USPC ..... 42/75.01–75.1
See application file for complete search history.

(56) References Cited

U.S. PATENT DOCUMENTS

| | | | | |
|---|---|---|---|---|
| 2,450,064 | A | 9/1948 | Wernli | |
| 2,747,313 | A | 5/1956 | Crittendon et al. | |
| 2,684,754 | A | 8/1964 | Crittendon et al. | |
| 3,198,076 | A | 8/1965 | Stoner | |
| 3,318,192 | A * | 5/1967 | Sullivan et al. | 89/142 |
| 5,501,135 | A | 3/1996 | Beretta | |
| 5,907,919 | A | 6/1999 | Keeney | |
| 6,205,696 | B1 | 3/2001 | Bilgeri | |
| 8,051,595 | B2 * | 11/2011 | Hochstrate et al. | 42/75.01 |
| 8,087,194 | B1 * | 1/2012 | Vuksanovich | 42/75.02 |
| 8,240,074 | B2 * | 8/2012 | Vuksanovich | 42/75.02 |
| 2007/0017139 | A1 | 1/2007 | Larue | |
| 2010/0175290 | A1 | 7/2010 | Duplessis et al. | |
| 2010/0313743 | A1 | 12/2010 | Dueck et al. | |
| 2010/0319231 | A1 | 12/2010 | Stone et al. | |
| 2012/0017483 | A1 * | 1/2012 | Vuksanovich | 42/75.02 |
| 2012/0131834 | A1 * | 5/2012 | Barrett et al. | 42/75.02 |
| 2012/0131835 | A1 * | 5/2012 | Barrett et al. | 42/75.02 |
| 2012/0216439 | A1 * | 8/2012 | Barrett et al. | 42/75.02 |

FOREIGN PATENT DOCUMENTS

WO WO 2010/111026 A1 9/2010

OTHER PUBLICATIONS

AR15Barrels.co,—6.8 SPC Group Buy #2 retrieved Jul. 28, 2010, from http://www.ar15barrels.com/68groupbuy.shtml.

(Continued)

*Primary Examiner* — Samir Abdosh
(74) *Attorney, Agent, or Firm* — Womble Carlyle Sandridge & Rice, LLP

(57) ABSTRACT

A barrel mounting and retention device for attaching a barrel to a receiver of a firearm. The barrel mounting and retention device can include a barrel extension disposed at a proximal end of the barrel, with an annular collar extending from the barrel extension and defining a first clamp face. A mounting plate having a second clamp face and defining a first axial bore fits over the barrel of the firearm with the barrel extending through the first axial bore. At least a portion of the second clamp face abuts a portion of the first clamp face as the mounting plate is secured to the barrel extension for mounting and retaining the barrel in communication with the receiver of the firearm.

12 Claims, 7 Drawing Sheets

(56) References Cited

OTHER PUBLICATIONS

AR-15/M16 M4 Barrel Extension, retrieved Dec. 8, 2011, from http://www.brownells.com/.aspx/pid=26946/Product/AR-15-M16-M4-BARREL-EXTENSION.

DPMS Panther Arms: Barrel Extension, retrieved Dec. 8, 2011, from http://www.brownells.com/.aspx/pid=5600/Product/Barrel-Extension.

Bushmaster ACR Operating and System Manual, date unknown.

Changing your own AR15 barrel for dummies, retrieved Jun. 22, 2010 from http://wwvv.ar15.com/forums/topic.html?b=3&f=4&t=226782.

International Search Report for PCT/US2012/041141 dated Sep. 5, 2012.

Written Opinion for PCT/US2012/041141 dated Sep. 5, 2012.

* cited by examiner

BARREL MOUNTING AND RETENTION MECHANISM

TECHNICAL FIELD

Embodiments of the disclosure are directed generally to gas operated firearms and, more particularly, to an apparatus for mounting a barrel to the receiver of a gas-operated firearm.

BACKGROUND INFORMATION

Semi-automatic firearms, such as rifles and shotguns, are designed to fire a round of ammunition, such as a cartridge or shot shell, in response to each squeeze of the trigger of the firearm, and thereafter automatically load the next shell or cartridge from the firearm magazine into the chamber of the firearm. During firing, the primer of the round of ammunition ignites the propellant inside the round, producing an expanding column of high pressure gases within the chamber and barrel of the firearm. The force of this expanding gas propels the bullet/shot of the cartridge or shell down the barrel.

In some types of semi-automatic rifles and shotguns, a portion of the expanding gases will be directed through a duct or port that interconnects the barrel of the firearm to a gas operating system, such as a piston assembly that houses an axially moveable gas piston, or a gas impingement system that directs the expanding gases to impinge on a bolt assembly within a receiver of the firearm. The barrel and the gas operating system typically are coupled to the receiver and aligned with the bolt assembly of the firearm so that the gas operating system can act on the bolt assembly as part of the semi-automatic loading and operation of the firearm so as to cause the rearward motion of the bolt assembly. This rearward motion of the bolt assembly opens the chamber, ejects the empty shell or cartridge casing, and thereafter loads another shell or cartridge into the chamber, after which the bolt returns to a locked position for firing as the expanding gases dissipate or are bled off. The barrel further must be connected in alignment with the gas system to facilitate proper operation of the gas system.

In addition, in such semi-automatic and automatic firearms, it is desirable that the barrel be easily replaceable to enable change of calibers of ammunition to be used in the firearm and/or to provide for replacement of damaged barrels or use of barrels of different lengths for different end use scenarios. The changeout of barrels is, however, complicated by the use of various hand guards and accessory rail assemblies typically mounted about the barrels of such firearms, as well as the increasing use of monolithic or one-piece receiver and hand guard assemblies. Typically, such hand guards must be removed from the firearm prior to the removal and replacement of the barrel, increasing the difficulty and time required for barrel change-out.

Accordingly, it can be seen that a need exists for a barrel mounting and retention assembly that addresses the foregoing and other related and unrelated problems in the art.

SUMMARY OF THE DISCLOSURE

Briefly described, in one embodiment of the invention, a barrel mounting and retention device is provided for use with a gas-operated firearm. The barrel mounting and retention device can comprise a barrel extension defining a first axial bore and being disposed at a proximal end of the barrel, the barrel defining a chamber at least partially extending in the proximal end. An annular collar can be formed about a forward or first portion of the barrel extension and will comprise a first clamp face. At least a portion of the first clamp face can comprise a first oblique portion extending in an oblique direction with respect to a longitudinal axis of the barrel. A mounting plate, including a second clamp face and defining a second axial bore through which the barrel is received and extends will be received about the barrel and will engage the front face of the barrel extension.

At least a portion of the second clamp face comprises a second oblique portion extending in an oblique direction with respect to the longitudinal axis of the barrel. At least a portion of the second oblique portion is adopted to engage/abut at least a portion of the first oblique portion in a complimentary fitting engagement as the mounting plate is secured to and urged against a face of the receiver of the firearm by insertion of fasteners through a series of mounting bores formed about the periphery of the mounting plate. As the fasteners are tightened, urging the mounting plate toward the receiver, a clamping force is applied to the barrel extension and the annular collar. Any misalignment of the bores or fasteners is generally corrected by the engagement of the first and second clamp faces such that the clamping force applied to the barrel extension, and thus the barrel, is aligned and substantially maintained in a straight line with the longitudinal axis of the barrel. An alignment feature also can be provided extending from the barrel extension, for aligning the barrel extension with the receiver.

These and various other advantages, features, and aspects of the exemplary embodiments will become apparent and more readily appreciated from the following detailed description of the embodiments taken in conjunction with the accompanying drawings, as follows.

DETAILED DESCRIPTION OF THE EXEMPLARY EMBODIMENTS

Figure 1:
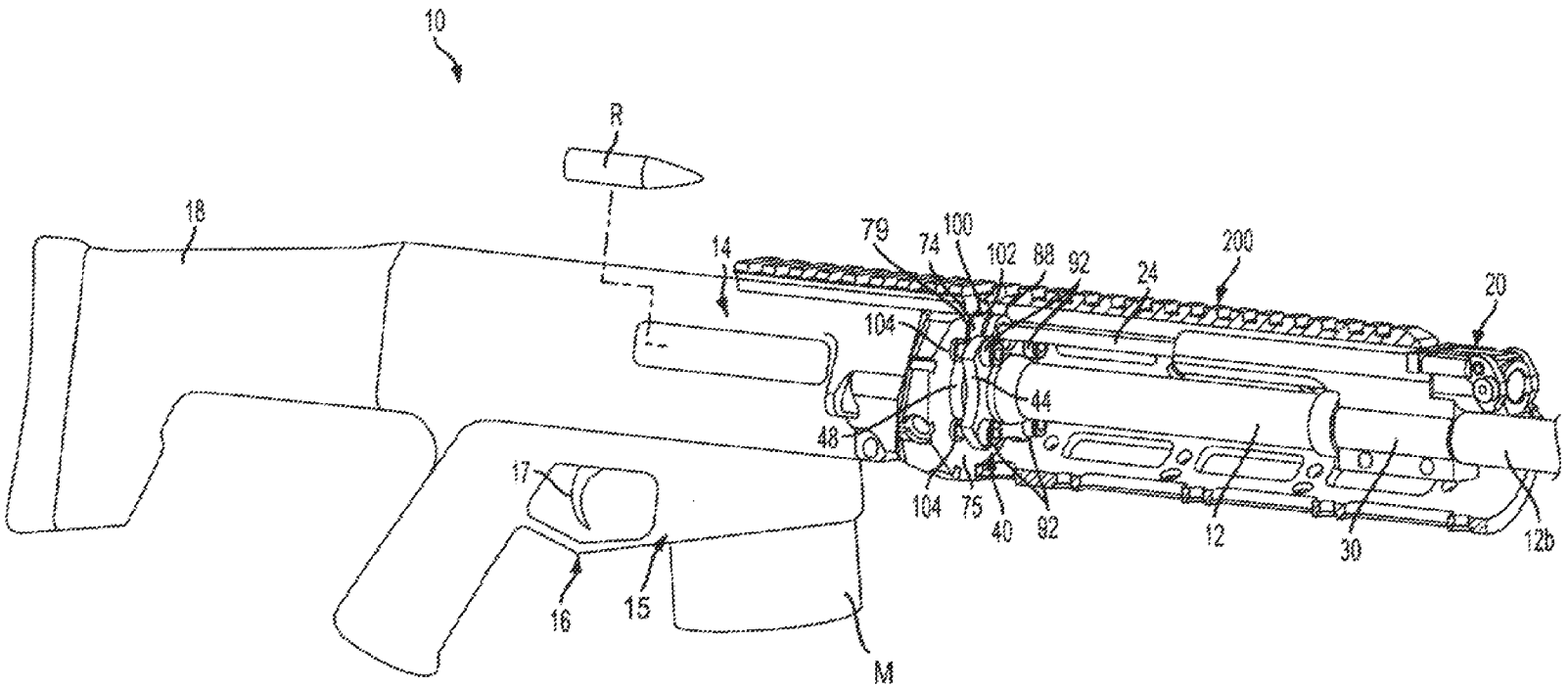
FIG. 1 is an isometric view, with parts broken away for clarity, of a gas-operated firearm with a barrel mounting and retention device according to an exemplary embodiment of the disclosure.

Referring now to the drawings in which like numerals indicate like parts throughout the several views, the figures illustrate one example embodiment of the barrel mounting and retention apparatus or system according to the principles of the present disclosure for use in a firearm such as an M4, M16, AR-15, SCAR, AK-47, HK416, ACR or similar type gas operated firearm. However, it will be understood that the principles of the barrel mounting and retention device of the present invention can be used in various types of firearms including shotguns, rifles and other long guns, hand guns, and other gas-operated firearms. The following description is provided as an enabling teaching of exemplary embodiments; and those skilled in the relevant art will recognize that many changes can be made to the embodiments described. It also will be apparent that some of the desired benefits of the embodiments described can be obtained by selecting some of the features of the embodiments without utilizing other features. Accordingly, those skilled in the art will recognize that many modifications and adaptations to the embodiments described are possible and may even be desirable in certain circumstances, and are a part of the invention. Thus, the following description is provided as illustrative of the principles of the embodiments and not in limitation thereof, since the scope of the invention is defined by the claims.

FIG. 1 illustrates a gas-operated firearm 10 showing a gas operating system with a barrel mounting and retention device in one exemplary embodiment. The firearm 10 generally is shown as a rifle, with parts broken away for clarity, and includes a barrel 12 with a longitudinal axis L (FIG. 2), an upper receiver 14, lower receiver or chassis 15 including a fire control 16, a stock 18, a gas operating system 20 with a gas block 30, and a barrel mounting and retention device 40. Further, a hand guard assembly 200 can be affixed to and/or utilized with the firearm 10. Alternatively, any other type of hand guard can be affixed to and/or utilized with the firearm 10, or a hand guard can be omitted from the firearm. For example, the firearm can incorporate a monolithic, integral upper-style receiver and hand guard, wherein the hand guard is integrally formed with the receiver, or an AR-style two-piece receiver and hand guard. The stock 18, also known as the buttstock or shoulder stock, may be formed in any conventional manner to include cushioning, special curvatures, grips, in a holding stock portion, etc. The upper receiver 14 houses and includes the firing mechanism or fire control 16 of the firearm, including a trigger 17 for actuating the firearm, a breech bolt or bolt assembly, and a firing pin is shown. The bolt assembly is translatable axially in both forward and rearward directions along the receiver during the firing cycle and generally is located behind and communicates with a chamber portion 19 (FIG. 3) of the barrel 12, located at a proximal end of the barrel 12 adjacent or at least partially within the receiver 14. The chamber receives a round of ammunition R, such as a shell or cartridge for firing, typically from a magazine M (FIG. 1) received within the lower receiver 15.

Figure 2:
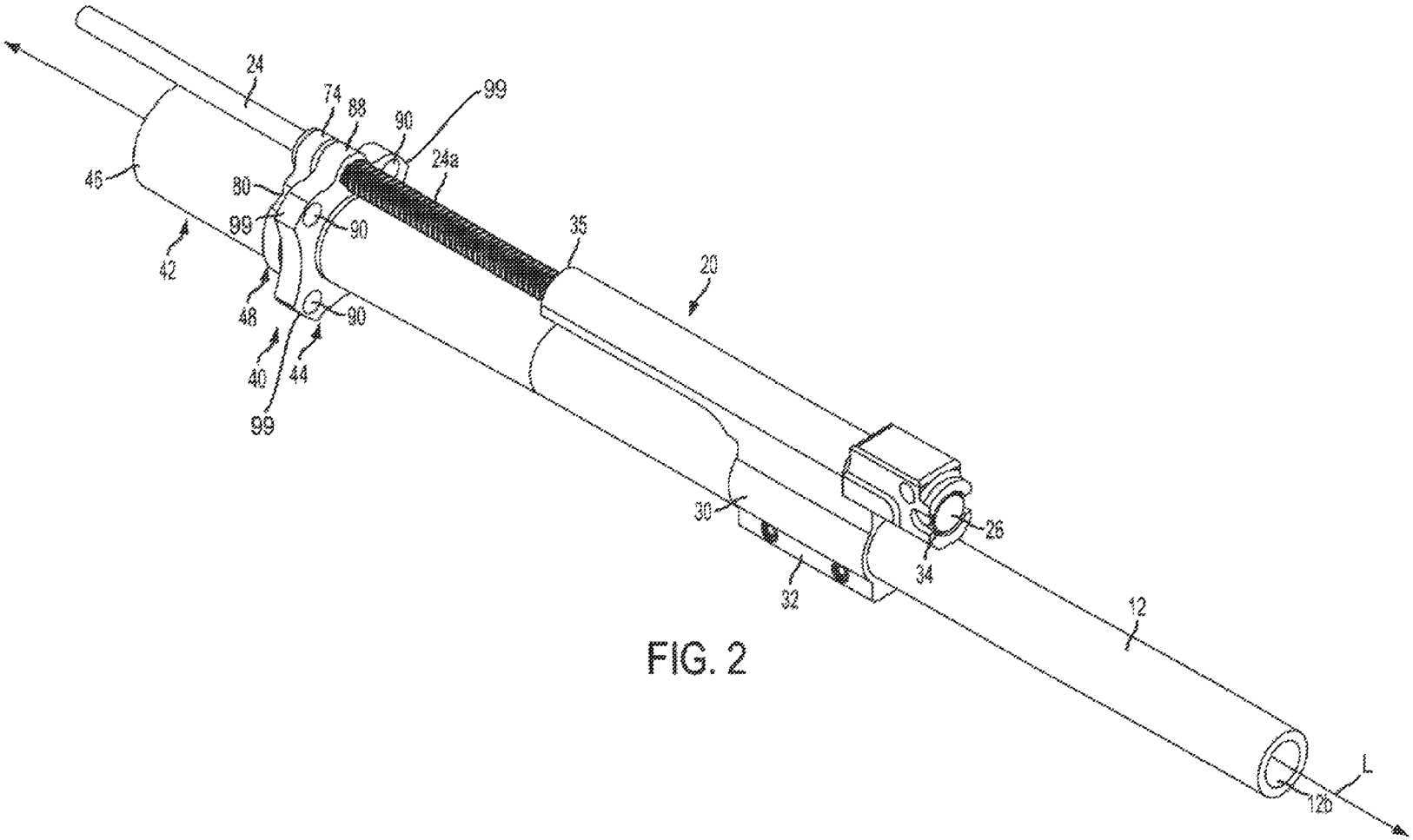
FIG. 2 is an isometric view of a gas operating system, a barrel extension, a mounting plate, and the barrel of FIG. 1.

In the gas-operated semi-automatic firearm 10 illustrated in FIGS. 1 and 2, the gas operating system 20 is shown in one embodiment as including a gas-operated piston assembly 21 for operation of the firearm for ejecting a spent shell or casing and reloading the chamber after firing by way of mechanical interconnection and interaction between the piston assembly 21 and the bolt assembly of the firearm. During a firing operation, a portion of the expanding combustion gases from the barrel is directed into the gas block 30 of the gas operating system 20, which gas flow accordingly contacts and drives the gas piston 22 rearwardly. This rearward movement or action of the gas piston 22, in turn is translated to the bolt, to cause a spent cartridge/shell casing to be automatically cleared or ejected from the chamber 19, a new round R to be loaded into the chamber, and the hammer and bolt to be recocked and readied for a next firing cycle.

Figure 3:
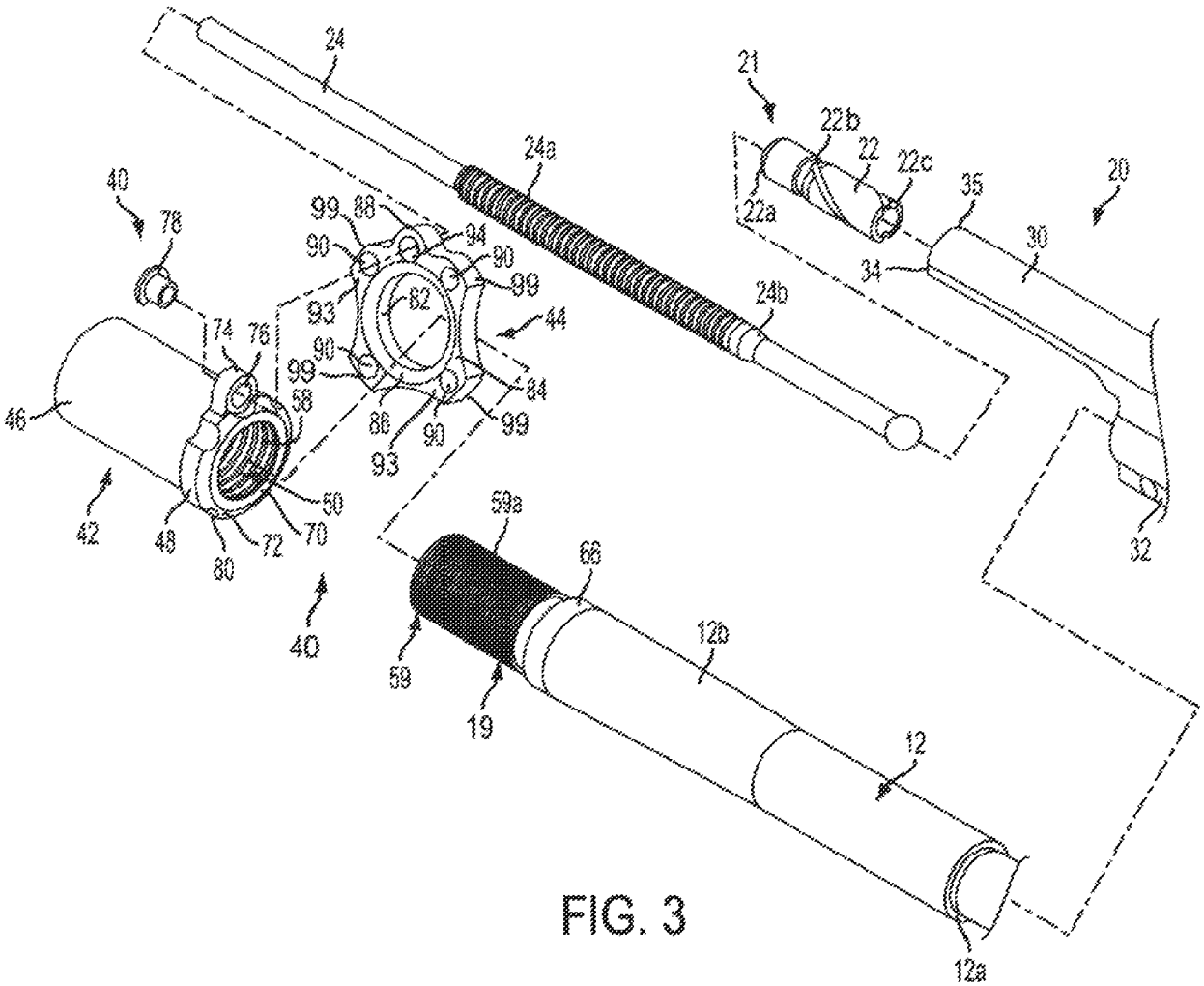
FIG. 3 is an exploded isometric view of the barrel extension, the mounting plate, the barrel, and the gas operating system.

As shown in FIGS. 2 and 3, the gas operating system 20 includes gas piston 22 housed within gas block 30, an operating rod 24 adapted to be engaged by the piston 22 during operation, and a gas plug 26 adapted to be received within and housed by the gas block 30. The gas block 30 further includes a barrel band 32 adapted to fit over and clamp about the barrel 12 to secure the gas operating system thereto, and a gas block bore 34 extending longitudinally there through. The barrel band 32 engages the barrel 12, abutting a shoulder portion 12*a* thereof so that a gas port of the barrel (not shown) generally aligns with a gas port or inlet (not shown) for the gas block bore 34, which extends through the gas block between the barrel gas port and the gas block bore. The aligned barrel orifice and gas port enable a portion of the combustion gases generated during firing to communicate from the bore of the barrel 12 into the gas block bore 34.

As shown in FIG. 3, the operating rod 24 of the firearm's gas operating system 20 generally is located rearwardly of the gas piston in a position aligned with and adapted to be engaged by a first end 22*a* of the gas piston 22 as the gas piston slides along the gas block bore 34 of the gas block housing after firing, with both the operating rod and the gas piston being slideable within the gas block bore and along the gas block for a desired amount of travel. The operating rod 24 (FIGS. 1 and 2) extends beyond the rearward end 35 of the gas block bore 34 and through the barrel mounting and retention device 40, as described below for engaging the bolt assembly in the receiver 14. A piston return spring 24*a* can be concentrically mounted on the operating rod 24, engaging a rod shoulder 24*b* and the barrel mounting and retention device 40 in order to bias the operating rod 24 and the gas piston 22 forwardly. Alternatively or in addition, the gas piston also can be spring biased toward its forward, non-operative position. The gas piston 22 can be biased to a position where a reduced diameter portion 22*b* of the gas piston, or other portion capable of receiving the gases, is generally aligned with the gas port so as to enable a passage of gases from the barrel into the gas block bore 34.

As further indicated in FIG. 2, the gas plug 26 fits within the open forward end of the gas block in sealing engagement with the gas block bore 34. The incoming flow of exhaust or combustion gases can act against the gas plug 26 and the second upstream end 22*c* (FIG. 3) of the piston so as to cause the gas piston 22 to move the gas piston rearwardly along the gas block bore 34. Additional details of an exemplary gas piston, an exemplary gas operating system in general, and an exemplary firearm incorporating the same are included in co-pending U.S. patent application Ser. No. 12/818,291, filed Jun. 18, 2010, which application is hereby incorporated by reference for all purposes as if presented herein in its entirety.

Figure 4:
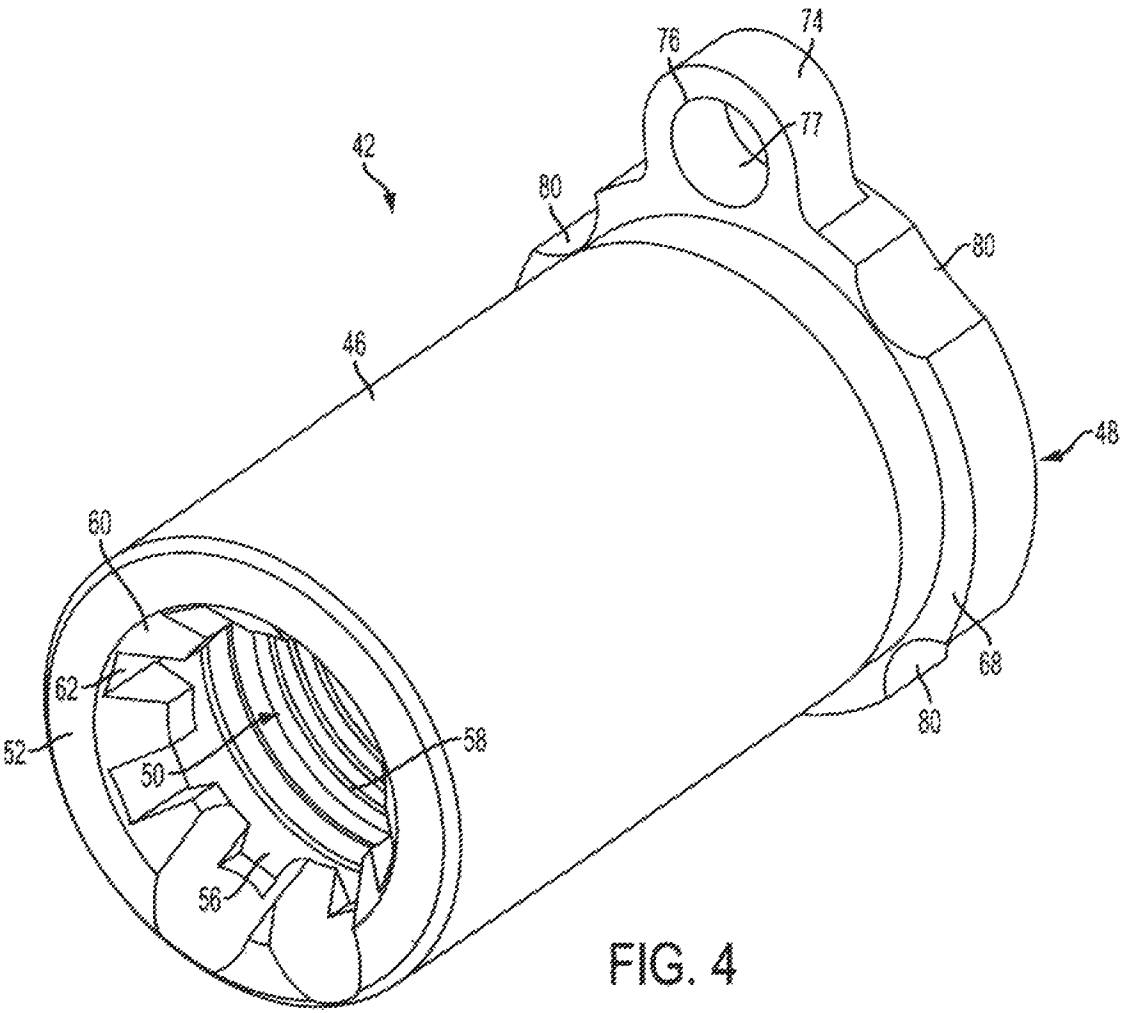
FIG. 4 is an isometric view of the barrel extension.
Figure 5:
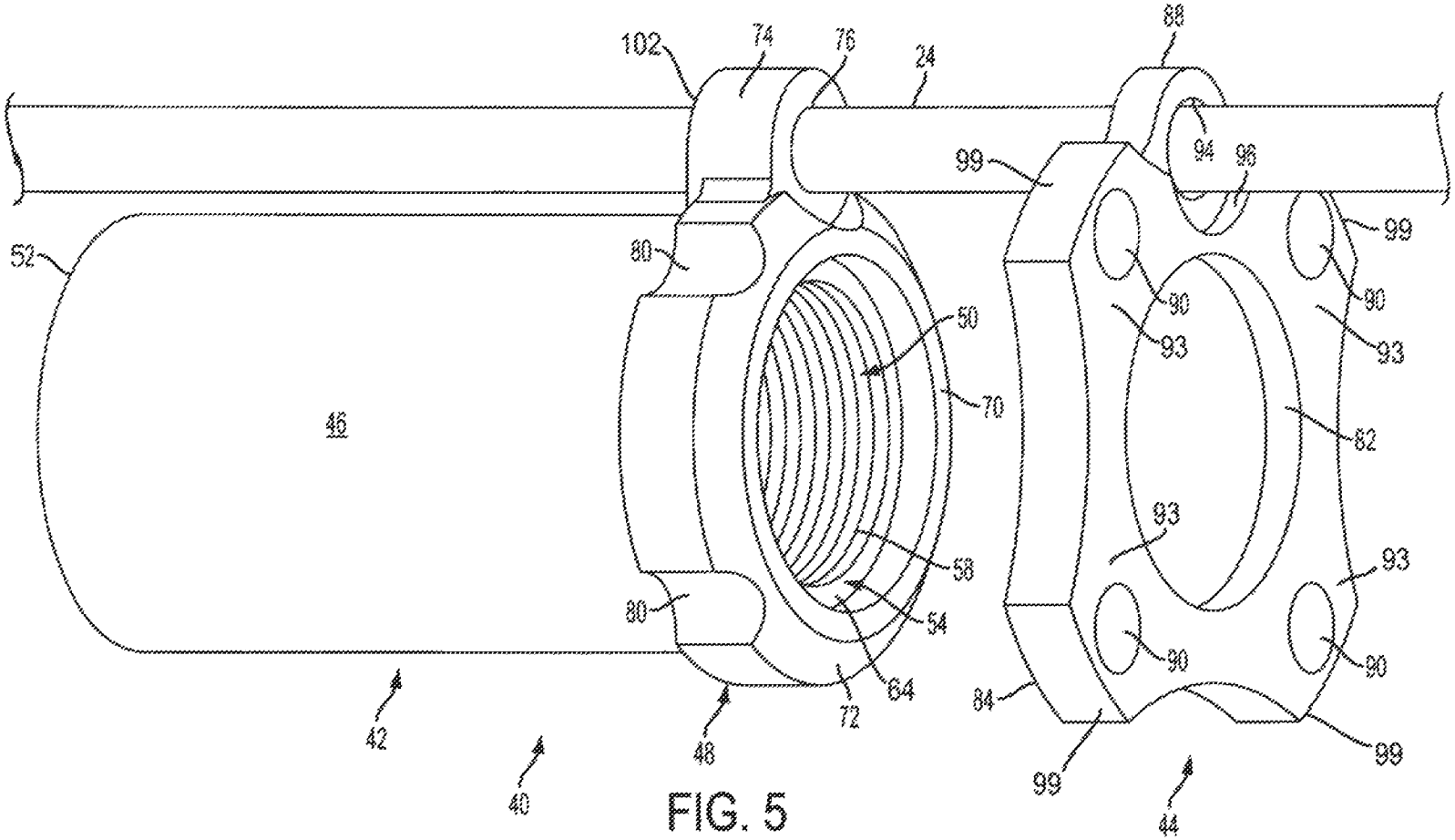
FIG. 5 is an isometric view of the barrel extension and the mounting plate aligned with the operating rod of the gas operating system.

As shown in FIGS. 1-3, the barrel mounting and retention device 40 includes a barrel extension 42 and a mounting plate 44 that cooperate to secure and retain the barrel 12 in abutting engagement with the receiver 14. As shown in FIGS. 4 and 5, the barrel extension 42 generally includes a cylinder section 46 and an annular boss or collar 48. The cylinder section 46 will include an axial bore 50 extending from a bolt-receiving end 52 of the barrel extension to a barrel-receiving end 54 adjacent the collar 48. As shown in FIG. 4, the axial bore 50 can include a bolt interlocking section 56 (FIG. 6) adjacent the bolt-receiving end 52 and a threaded section 58 extending from the bolt interlocking section 56 to the barrel-receiving end 54 for engaging external threads 59*a* formed about a proximal end 59 or the chamber portion 19 of the firearm. The cylinder section 46 can slide axially into the receiver 14 (FIG. 1) to interface with the bolt assembly of the firearm 10.

Figure 6:
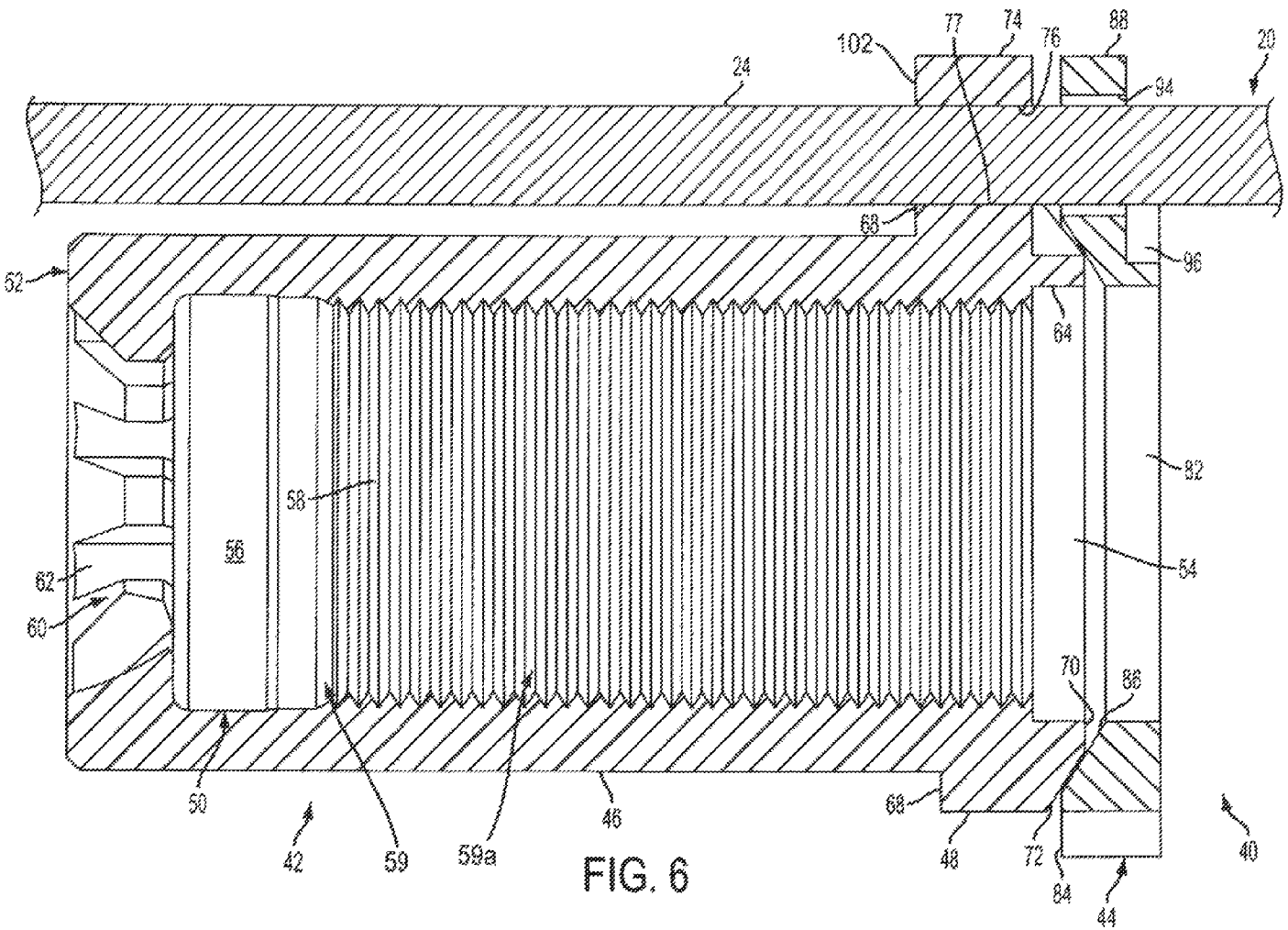
FIG. 6 is a cross-sectional view of the barrel extension and the mounting plate, and operating rod of the gas operating system.

As shown in FIGS. 4 and 6, the bolt-receiving end 52 further includes a plurality of locking lugs 60 extending radially into the axial bore 50 with recesses 62 formed between the locking lugs 60. The bolt assembly generally will include a breach bolt having a plurality of corresponding lugs and recesses at its forward end, with the lugs of the breach bolt engaging the recesses 62 of the barrel extension 42 while the locking lugs 60 of the barrel extension 42 engage the recesses of the breach bolt when the forward end of the breach bolt is passed through the bolt-receiving end 52 and into the interlocking section 56 of the barrel extension when chambering a round R into the chamber 15. Thereafter, with the lugs of the breach bolt received within the interlocking section 56, the bolt assembly can rotate to at least partially align the lugs of the breach bolt with the locking lugs 60 to lock the bolt assembly to the barrel extension 42 for firing the firearm 10. After a firing operation, the bolt assembly will rotate in an opposite direction as it moves rearwardly so that the lugs of the breach bolt are aligned with the recesses 62 and the breach bolt can withdraw from the barrel extension 42 to extract a spent shell or cartridge casing from the chamber and chamber another round.

As shown in FIG. 3, the threaded section 58 of the axial bore 50 can receive the proximal end 59 of the barrel 12, which includes at least a portion of the chamber 19. The threaded section 58 can be threaded for interfacing with the external threads 59*a* formed about the proximal end 59 of the barrel 12 for attaching the barrel to the barrel extension. An annular barrel stop shoulder 64 (FIG. 5) further can be formed at the barrel-receiving end 54 of the axial bore 50, as indicated in FIGS. 5-6, for engaging and abutting against a shoulder 66 (FIGS. 3 and 6) proximate the external threads 59*a* of the barrel 12 when the barrel extension barrel 42 is in engagement with the proximal end 59 of the barrel (FIG. 2). Alternatively, the annular barrel stop shoulder 64 (FIG. 5) can be omitted, and the rearward face of the shoulder 66 can engage a forward face of the threads formed at the barrel-receiving end 54 of the barrel extension.

As shown in FIGS. 4 and 5, the collar 48 of the barrel extension 42 is shown abutting the annular barrel stop shoulder 64, and generally includes a rearward face 68, a clamp face 70 with a generally oblique surface, here shown as a convex spherical surface 72, and a rod-receiving flange 74. The rearward face 68 extends outwardly from the cylinder section 46 in the radial direction to provide a generally flat rearward facing surface for engaging the forward facing surface 75 of the receiver 14 (FIG. 1). Accordingly, a clamp force applied along the longitudinal axis L of the barrel 12 tends to urge the rearward face 68 against the forward surface 75 of the receiver. The generally flat nature of the rearward face 68 allows proper seating of the collar 48 against the receiver 14 for secure retention of the barrel extension 42, and thus the barrel 12, to the receiver 14, as well as proper alignment of the longitudinal axis L of the barrel 12 with a longitudinal axis of the receiver, with minimal effort by a user. No additional tools are required for alignment of the barrel and the receiver. In the illustrated embodiment, the convex spherical surface 72 extends in an oblique direction with respect to the longitudinal axis L of the barrel 12, projecting generally away from the receiver 14 from the inner radius to the outer radius of the convex spherical surface 72. Further, in the illustrated embodiment, the convex spherical surface 72 includes a convex, curved cross-section. In an alternative embodiment, the convex spherical surface 72 can be any surface that extends in an oblique direction with respect to the longitudinal axis L of the barrel 12.

The rod-receiving flange 74 includes a through-bore 76 for aligning the operating rod 24 with the opening in the receiver 14. The rod-receiving flange 74 can provide a bearing and/or guide surface 77 for supporting the operating rod 24 as it reciprocates during the operation of the firearm 10. An optional bushing 78 (FIG. 3) also can be inserted into the through-bore 76 of the rod-receiving flange 74 to provide the bearing surface. Additionally, as indicated in FIG. 1, when the barrel extension 42 is mounted in engagement with the receiver 14, the rod-receiving flange generally becomes aligned with a corresponding opening 79 in the receiver so that the operating rod 24 can extend into the receiver and either directly or indirectly engage the bolt assembly. Alternatively, the bore of the rod-receiving flange 74 can be formed with a sufficient size to provide clearance for the operating rod 24 to pass through and into the receiver 14, or the rod-receiving flange 74 could be omitted so that the operating rod 24 passes directly into the receiver 14 without engaging the barrel extension 42, without departing from the scope of the present disclosure. Three or more longitudinal recesses 80 further can be included in the collar 48 for providing guide surfaces and/or clearance for insertion of mechanical fasteners 92 there through to secure the barrel mounting apparatus 40 to the receiver 14 (FIG. 1).

As illustrated in FIGS. 3, 5, and 6, the mounting plate 44 can include an axial bore 82, a rear mounting plate face 84 with a generally oblique engagement surface, here shown as a concave spherical surface 86, a rod-receiving flange 88, and four recesses or bores 90 generally are arranged around the axial bore 82 though fewer or more holes also can be provided. The axial bore 82 provides clearance for the shoulder 66 of the barrel 12 to pass through and engage the barrel extension 42. Accordingly, the mounting plate 44 can slide over and along the barrel 12 to engage the collar 48, as shown in FIGS. 1 and 2. In the illustrated embodiment, the concave spherical surface 86 extends in an oblique direction with respect to the longitudinal axis L of the barrel 12, projecting generally toward the receiver 14 from the inner radius to the outer radius of the concave spherical surface 86. Further, in the illustrated embodiment, the concave spherical surface 86 comprises a concave, curved cross-section. In an alternative embodiment, the concave spherical surface 86 can be any surface that extends in an oblique direction with respect to the longitudinal axis L of the barrel 12. In a further alternative embodiment, any of the features of the clamp face 70 of the collar 48 can be exchanged with the respective features of the clamp face 84 of the mounting plate 44. For example, the clamp face 70 of the collar can include an oblique surface extending toward the receiver 14 and the clamp face 84 of the mounting plate can include an oblique surface extending away from the receiver 14.

The concave spherical surface 86 interfaces with the convex spherical surface 72 of the collar 48 to provide a straight-line clamping force between the mounting plate 44 and the barrel extension 42 while correcting for any misalignment of the bores 90. Stated another way, the interfacing convex and concave surfaces tend to align the axial bore 50 of the barrel extension 42 with the axial bore 82 of the mounting plate 44 and counter any forces that would otherwise move the axial bores out of alignment. For example, if any one or more mechanical fastener inserted through bores 90 create or apply an unequal force to one side of the mounting plate 44, the convex spherical surface 72 of the collar 48 applies a reaction force to the concave spherical surface 86 of the mounting plate 44, causing the mounting plate to shift or adjust to counter the excess force of the fastener(s). Further, if the mounting plate 44 is urged against the collar 48 with the axial bore 82 misaligned with the axial bore 50, the curved surface of the clamp face 84 of the mounting plate will tend to slide against the curved surface of the clamp face 70 of the collar until the convex surface is properly seated in the concave surface thereby aligning the clamping force with the axial bore 50. In the illustrated embodiment, each of the convex spherical surface 72 and the concave spherical surface 86 can have a gradual curvature to its cross-section (FIG. 6), wherein, if the edges of the respective surfaces are extended along the same degree of curvature, each of the surfaces would form a substantially complete sphere. Alternatively, each of the convex spherical surface 72 and the concave spherical surface 86 could be replaced with a straighter or substantially flatter surface extending in an oblique direction with respect to the longitudinal axis of the barrel mounting and retention device 40.

Each of the bores 90 provides clearance for a fastener 92 (FIG. 1), such as cap screws or other mechanical fasteners. Alternatively, more or fewer fasteners 92 can be used in conjunction with a corresponding number of bores 90 in the mounting plate 44 and recesses 80 in the collar 48, which also can be arranged in various patterns around the respective axial bores 82, 50 of the mounting plate and collar, without departing from the scope of the present disclosure.

The rod-receiving flange 88 further can include a clearance bore 94 along an upper edge, which clearance bore will generally be aligned with the through-bore 76 of the rod-receiving flange 74 of the collar 48 when the axial bore 82 of the mounting plate is aligned with the axial bore 50 of the barrel extension 42 by the interfacing convex spherical surface 72 and concave spherical surface 86 described above. Accordingly, the operating rod 24 can extend through the clearance bore 94 to the rod-receiving flange 74 of the collar 48. The rod-receiving flange 88 additionally can include a spring seat 96 (FIGS. 5 and 6) for receiving the proximal end of the spring 24*a*. Accordingly, the spring 24*a* can rest/engage the mounting plate within the seat 96, and will bear against the rod-receiving flange 88 and the rod shoulder 24*b* during operation of the gas operating system 20. Alternatively, the rod-receiving flange 88 also can provide a bearing surface for supporting the operating rod 24, or the rod-receiving flange 88 could be omitted so that the operating rod 24 passes into the through-bore 76 without engaging the mounting plate 44, without departing from the scope of the present disclosure.

In the illustrated embodiment of FIG. 5, the mounting plate 44 is shown as including substantially concave cutouts 98 for reducing the size and weight of the mounting plate 44 while providing areas 93 in increased size for formation of the bores 90 and surfaces for engaging the mechanical fasteners 92 inserted through the bores at the corners 99 of the mounting plate. Alternatively, the mounting plate 44 can have any shape capable of fitting within the firearm without departing from the scope of the disclosure.

As shown in FIG. 3, the firearm 10 is at least partially assembled by inserting the proximal end 59 of the barrel 12 into the axial bore 82 of the mounting plate 44 with the clamp face 84 of the mounting plate directed rearwardly and away from the muzzle and or down-bore section 12*b* of the barrel. The proximal end 59 of the barrel then will be inserted into the barrel extension 42 at the barrel-receiving end 54 thereof, and threads 59*a* of the proximal end 59 engaged with the threads of the threaded section 58 of the cylinder section 46. The barrel extension 42, the barrel 12, or both generally are rotated about their respective axes so as to screw the proximal end 59 of the barrel into engagement with the threaded section 58 until the shoulder 66 of the barrel 12 engages the barrel extension 42 at the barrel receiving end 54. The proximal end 59 of the barrel can be screwed into the threaded section 58 with sufficient torque so that the friction between the contacting surfaces of the barrel 12 and the barrel extension 42 resists loosening of the proximal end of the barrel from the engagement within the axial bore 50. In a particular embodiment, the proximal end can be further secured to the barrel extension 42 with adhesives, set screws, other fasteners, or combinations thereof, although such additional attachment devices are not required with the present invention. Accordingly, the proximal end 59 (FIG. 3) of the barrel 12 is received within the axial bore 50 with the open end of the chamber portion 19 (FIG. 1) adjacent the interlocking section 56.

The cylinder section 46 of the barrel extension 42 can be inserted into the opening in the forward surface 75 of the receiver 14 until the rearward face 68 of the collar 48 engages the forward surface 75. The forward surface 75 also can include an indexing recess 100 (FIG. 1) that receives an indexing protrusion 102 of the rod-receiving flange 74 (FIGS. 5 and 6). The indexing protrusion 102 can extend from the rearward face 68 of the collar 48 to engage the indexing recess 100 so that the through-bore 76 is aligned with the opening in the receiver 14 for receiving the gas operating rod 24, whereupon the recesses 80 of the collar 48 further can become aligned with tapped holes 104 in the forward surface 75, and the locking lugs 60 and recesses 62 will be aligned to receive the breach bolt of the bolt assembly within the receiver 14. Alternatively, the indexing recess 100 and the indexing protrusion 102 can be otherwise configured or omitted without departing from the scope of the present disclosure.

In the illustrated embodiment, the mounting plate 44 is brought into engagement with the collar 48 so that the concave spherical surface 86 of the mounting plate abuts the convex spherical surface 72 of the collar (FIG. 6) to align the clamping force of the mounting plate with the axial bore 50 of the barrel extension 42. The mounting plate 44 can be rotated to align the clearance bore 94 with the through-bore 76, and the mechanical fasteners 92 can be inserted into the bolt holes 90 (FIG. 1). The fasteners 92 can slide over the respective guide surfaces of the recesses 80 to further align the bores 90 with the tapped holes 104 in the forward surface 75 of the receiver 14. The fasteners 92 can be screwed into the tapped holes 104 to clamp the collar 48 between the mounting plate 44 and the forward surface 75. Accordingly, the longitudinal clamping forces generated by the engagement of the fasteners 92 with the collar 48, mounting plate 44 and the receiver secure the barrel extension 42 and the barrel 12 to the receiver 14. Any misalignment of the bores 90 with the tapped holes 104 or any uneven torquing of the mechanical fasteners 92 that may apply a transverse force to the mounting plate 44 or the barrel extension 42, which otherwise would cause a misalignment of the barrel and receiver, generally will be countered by the interface between the convex spherical surface 72 and the concave spherical surface 86 to maintain a generally straight-line clamping force between the mounting plate 44, the collar 48, and the forward surface 75 of the receiver 14, which clamping force generally will be aligned with the longitudinal axis L of the barrel 12 of the firearm to maintain the barrel in a straight line orientation/alignment. For example, a transverse force applied to the mounting plate 44 by one or more of the mechanical fasteners 92 generally will be countered by a reaction force between the convex spherical surface 72 and the concave spherical surface 86 at an opposite side of the barrel mounting and retention device 40 from the particular mechanical fastener. Additionally, the illustrated embodiment, the collar 48 of the barrel extension 42 includes the convex spherical surface 72 and the clamp face 84 of the mounting plate 44 includes the concave spherical surface 86, however, the collar 48 alternatively can be configured with a concave spherical surface, and the mounting plate 44 can be configured with a corresponding convex spherical surface without departing from the scope of the present disclosure.

As indicated in FIGS. 2 and 3, the gas operating system 20 will be secured to the barrel 12 by sliding the barrel band 32 of the gas block 30 over the barrel 12 until it abuts the shoulder portion 12*a*. The gas block 30 is aligned with the barrel 12 to align gas ports (not shown) in the barrel and gas block to allow fluid communication between the interior of the barrel and the gas block bore 34. The operating rod 24 and the piston return spring 24*a* are inserted into the gas block bore 34 so that the operating rod extends through the rearward end 35 of the gas block bore. The operating rod can be inserted through the clearance bore 94 of the rod-receiving flange 88, the through-bore 76 of the rod-receiving flange 74, and into the receiver 14 to engage the bolt assembly within the receiver. Accordingly, the rod-receiving flange 74, which includes the indexing protrusion 102 engaging the indexing recess 100 in the receiver 14 for aligning the through-bore 76 with the opening in the receiver, automatically aligns the operating rod 24 with the opening in the receiver. This allows smooth operation of the operating rod into the receiver, and proper engagement of the operating rod with the bolt assembly within the receiver without requiring substantial effort by a user. Optionally, bushing 78 also can be inserted into the through-bore 76 of the rod-receiving flange 74 of the barrel extension 42 such as by a press fit, or additionally, by adhesives or other fasteners. Alternatively, this optional bushing can be omitted. The piston return spring 24*a* is generally situated on the operating rod 24 between and abutting the rod shoulder 24*b* and the rod-receiving flange 88 of the mounting plate 44. The spring 24*a* can be further supported by the spring seat 96 of the mounting plate. The gas piston 22 and the gas plug 26 then will be inserted into the gas block bore 34 with the gas plug 26 sealing the forward end of the gas block bore (FIG. 2). Alternatively, the gas operating system 20 can be assembled onto the barrel 12 and the barrel mounting and retention device 40 before affixing the barrel mounting and retention device 40 and barrel to the receiver 14 without departing from the scope of the present disclosure.

In operation, the firearm 10 (FIG. 1) is prepared for firing when the bolt assembly loads a round of ammunition R in to the chamber portion of the firearm. The forward end of the breach bolt carries the round into the axial bore at the bolt-receiving end 52 of the cylinder section 46 and the lugs of the breach bolt pass through the recesses 62 between the locking lugs 60 at the bolt-receiving end 52. With the lugs of the breach bolt in the interlocking section 56, the round R is fully inserted into the chamber portion 19 of the barrel 12, and the breach bolt rotates to align the lugs of the breach bolt with the locking lugs 60 at the bolt-receiving end 52 and lock breach bolt to the barrel extension 42 with the round in the chamber portion 19. When the fire control 16 is actuated, a firing pin (not shown) strikes the primer of the round, igniting the propellant. Expanding gases from the ignited propellant build up pressure in the barrel 12, driving the bullet portion of the round through the down bore section 12*b* of the barrel. Some of the expanding gases flow through the gas port (not shown) extending between the rifled section 12*b* and the gas block bore 34 to drive the gas piston 22 rearwardly in the gas block bore. The gas piston 22, in turn, drives the operating rod 24 rearwardly against the piston return spring 24*a* and which drives the bolt assembly rearwardly within the receiver. The breach bolt then rotates within the interlocking section 56 in the axial bore 50 to unlock the lugs of the breach bolt from the barrel extension 42, extracting the spent casing of the round R from the chamber and ejecting the spent casing from the firearm 10 after which a new round is loaded into the chamber. The piston return spring 24*a* thereafter drives the operating rod forwardly to return the gas piston 22 to the pre-firing position within the gas block bore 34.

It should be noted that the firearm 10 alternatively could include a gas impingement operating system 20 (FIG. 7) including a gas impingement tube 24' for operation of the firearm for ejecting a spent shell or cartridge casing and reloading the chamber after firing by way of redirection of the expanding combustion gas flow to the bolt assembly of the firearm, instead of the piston-type gas operating system described above, without affecting the operation of the barrel mounting and retention device 40. The gas impingement tube 24' can be positioned within the gas block bore 34 (FIG. 3) and extended beyond the rearward end 35 of the gas block bore and into the receiver 14 to the bolt carrier. Such a gas impingement tube 24' generally would also include a flange (not shown) providing a sealing engagement with the gas block bore 34 so that the gas flow entering the gas block bore from the barrel 12 flows into and along the gas impingement tube so as to impinge on the bolt.

During a firing operation, a portion of the expanding combustion gases from the barrel is directed into the gas block 30, which gas flow accordingly is directed rearwardly into the gas impingement tube 24' (FIG. 4), which terminates at a gas key of the bolt carrier. This rearward gas flow applies a rearward pressure on the bolt carrier, which functions to cause a spent cartridge/shell casing to be automatically cleared or ejected from the chamber, a new round of ammunition to be loaded into the chamber, and the firing pin and bolt to be recocked for a next firing cycle.

Figure 7:
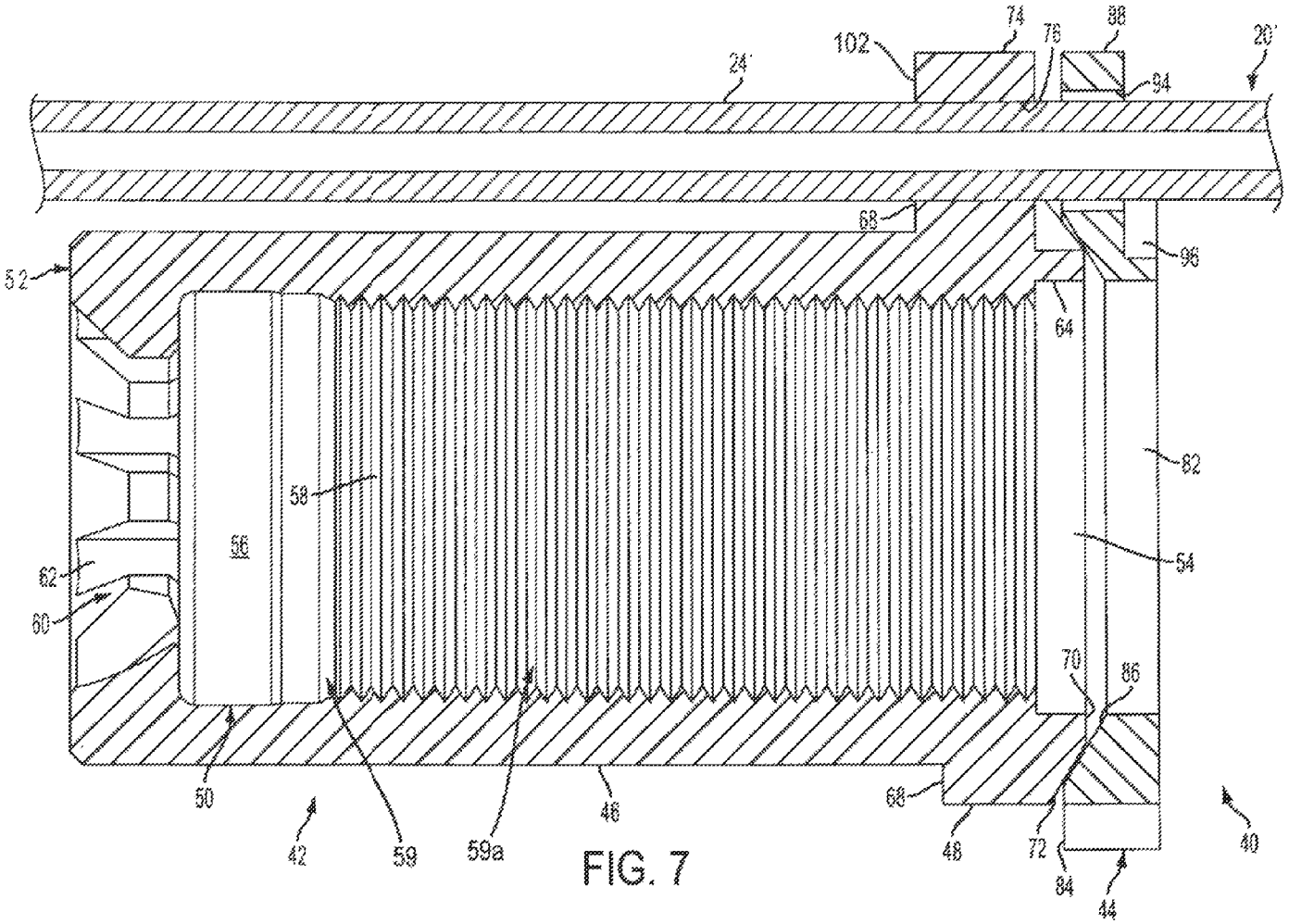
FIG. 7 is a cross-sectional view of another embodiment of the barrel extension and the mounting plate engaged with a gas impingement tube of an alternative gas operating system.

As shown in FIG. 7, the gas impingement tube 24' extends through the clearance bore 94 of the rod-receiving flange 88 of the mounting plate 44 and through the through-bore 76 of the rod-receiving flange 74 of the collar 48 to the opening in the receiver 14. Particularly, the through-bore 76 and the opening in the receiver are radially aligned by the engagement of the indexing protrusion 102 of the rod-receiving flange 74 with the indexing recess 100 in the forward surface 75 of the receiver, and axially aligned by engagement of the rearward face 68 of the collar 48 with the forward surface 75. The clearance bore 94 and the through-bore 76 are radially aligned by engagement of the fasteners 92 extending through the bores 90 with the longitudinal recesses 80, and axially aligned by the interface of the convex spherical surface 72 and the concave spherical surface 86. Accordingly, the clearance bore 94 and the through-bore 76 will guide the gas impingement tube 24' into the receiver 14 and support the gas impingement tube 24' so that the gas impingement tube 24' is properly aligned with the receiver and the bolt assembly therewithin. One or both of the rod-receiving flanges 88, 94 can be alternatively configured or omitted without departing from the scope of the present disclosure.

In addition, variations of the piston-type and gas impingement-type gas operating systems can be used in cooperation with the barrel mounting and retaining device 40. For example, while the gas operating system 20 is generally oriented above the barrel 12 in the illustrated embodiment, the gas operating system can alternatively be oriented at any position around the barrel. Particularly, the gas block 30 can be oriented with the gas block bore 34 situated below the barrel 12 with the operating rod 24 or gas impingement tube 24' extending from the rearward end 35 below the barrel. In such an alternative embodiment, the barrel extension 42 and the mounting plate 44 also generally will be oriented with the rod-receiving flanges 74, 88 below the barrel to receive the operating rod 24 or gas impingement tube 24. Further, the gas block 30 shown and described is included by way of example. Alternative gas block configurations can be used without departing from the scope of the present disclosure.

In still a further alternative embodiment, the barrel extension 42 can be integral with the barrel 12. Stated another way, the cylinder section 46 of the barrel extension can be incorporated into the proximal end 59 of the barrel and the collar of the barrel extension can be integrally formed with the external surface of the barrel 12.

It therefore can be seen that the construction of the gas-operated firearm with a barrel mounting and retention device according to the principles of the present disclosure provides a firearm with an apparatus for affixing and retaining the barrel in a locked engagement with the receiver while further providing for substantially automatic indexing and aligning of the components of the barrel mounting and retention device with the receiver. Thus, the barrel mounting and retention device facilitates a user's easy-attachment and removal/replacement of the barrel to the receiver of a firearm, including firearms with integral or monolithic upper receivers having hand guards integrally attached or formed therewith. The present barrel mounting and retention system further enables replacement of the barrel without having to remove and/or replace the hand guard or other access device of the firearm.

The corresponding structures, materials, acts, and equivalents of all means plus function elements in any claims below are intended to include any structure, material, or acts for performing the function in combination with other claim elements as specifically claimed.

Those skilled in the art will appreciate that many modifications to the exemplary embodiments are possible without departing from the scope of the invention. In addition, it is possible to use some of the features of the embodiments described without the corresponding use of the other features. Accordingly, the foregoing description of the exemplary embodiments is provided for the purpose of illustrating the principle of the invention, and not in limitation thereof, since the scope of the invention is defined solely be the appended claims.

What is claimed is:

1. A barrel mounting and retention device for attaching a barrel to a receiver of a firearm, comprising:

a barrel extension disposed at a proximal end of the barrel, the barrel defining a first axial bore at least partially extending along the proximal end of the barrel;

an annular collar located at a forward end of the barrel extension adjacent the proximal end of the barrel, and comprising a first clamp face defined about the barrel, at least a portion of the first clamp face comprising a first oblique portion extending in an oblique direction with respect to a longitudinal axis of the barrel; and a mounting plate having a substantially flat configuration and defining a second axial bore aligned with a third axial bore formed in the barrel extension, the barrel extending at least partially through the second and third axial bores, the mounting plate comprising a second clamp face formed along a rearward facing side surface thereof, at least a portion of the second clamp face comprising a second oblique portion extending in an oblique direction with respect to the longitudinal axis of the barrel;

wherein at least a portion of the second oblique portion engages at least a portion of the first oblique portion as the mounting plate and annular collar are moved into engagement so as to adjust a position of the mounting plate to substantially align the second bore of the mounting plate with the third axial bore of the barrel extension as the mounting plate is moved toward the receiver, a clamping force applied against the barrel extension is aligned with a central axis of the barrel of the firearm so as to resist misalignment of the mounting plate.

2. The barrel mounting and retention device of claim 1, wherein the first oblique portion comprises a convex spherical surface, and the second oblique portion comprises a concave spherical surface.

3. The barrel mounting and retention device of claim 1, wherein the barrel extension comprises a cylinder section extending from a bolt-receiving end to a barrel-receiving end of the barrel extension, the cylinder section defining the third axial bore in which the proximal end of the barrel is received.

4. The barrel mounting and retention device of claim 1, and further comprising an alignment feature extending from the barrel extension for aligning the barrel extension with the receiver.

5. The barrel mounting and retention device of claim 1, wherein the barrel extension comprises a plurality of locking lugs extending into the third axial bore at the bolt-receiving end of the barrel extension, the third axial bore of the barrel extension comprising an interlocking section adjacent the locking lugs.

6. The barrel mounting and retention device of claim 1, wherein at least the proximal end of the barrel is threaded, and the third axial bore of the barrel extension comprises a threaded section threadedly engaged with the proximal end of the barrel.

7. The barrel mounting and retention device of claim 1, wherein a flange extends from the collar of the barrel extension for engaging an operating rod of a gas operating system, the flange defining a through-bore having a bearing surface and through which the operating rod is received.

8. The barrel mounting and retention device of claim 7, and further comprising an indexing protrusion extending from the flange, the indexing protrusion for engaging an indexing recess defined by the receiver.

9. The barrel mounting and retention device of claim 7, wherein the flange is a first flange and the mounting plate comprises a second flange defining a clearance bore for receiving the operating rod.

10. A barrel mounting and retention device for attaching a barrel to a receiver of a firearm, comprising:

a barrel extension disposed at a proximal end of the barrel, the barrel defining a first axial bore at least partially extending its proximal end;

an annular collar extending from the barrel extension and comprising a first clamp face about the first axial bore, at least a portion of the first clamp face comprising a first oblique portion extending in an oblique direction with respect to a longitudinal axis of the barrel; and a mounting plate comprising a second clamp face and defining a second axial bore, the barrel extending at least partially through the second axial bore, at least a portion of the second clamp face comprising a second oblique portion extending in an oblique direction with respect to the longitudinal axis of the barrel, and wherein the mounting plate comprises a plurality of bores disposed in a pattern coaxial with the first axial bore;

wherein at least a portion of the second oblique portion engages at least a portion of the first oblique portion as the mounting plate and annular collar are moved into engagement so as to adjust a position of the mounting plate so that as the mounting plate is moved toward the receiver, a clamping force applied against the barrel extension is aligned with a central axis of the barrel of the firearm.

11. A barrel mounting and retention device for attaching a barrel to a receiver of a firearm, comprising:

a barrel extension disposed at a proximal end of the barrel and defining an axial bore at least partially extending therethrough;

an annular collar extending from the barrel extension and comprising a first clamp face formed about the axial bore at a forward end of the annular collar, at least a portion of the first clamp face comprising a first spherical surface; and a mounting plate movable into engagement with the annular collar of the barrel extension and defining a second axial bore through which the barrel extends, the mounting plate having a second clamp face comprising a second spherical surface formed about the second axial bore;

wherein at least a portion of the second spherical surface cooperatively engages at least a portion of the first spherical surface as the mounting plate and annular collar are moved into engagement so as to adjust a position of the mounting plate with respect to the annular collar so that as the mounting plate is moved toward the receiver, the second axial bore of the mounting plate is substantially located in alignment with the axial bore of the barrel extension and a clamping force applied against the barrel extension substantially is aligned with a central axis of the barrel of the firearm.

12. A barrel mounting and retention device for attaching a barrel to a receiver of a firearm, comprising:

a barrel extension disposed at a proximal end of the barrel, and having a first axial bore at least partially extending therealong;

an annular collar formed at a forward end of the barrel extension, the annular collar comprising a flange defining a through-bore, and a first clamp face extending about the first axial bore, at least a portion of the first clamp face comprising a first oblique portion extending in an oblique direction with respect to a longitudinal axis of the barrel; and a mounting plate defining a second axial bore through which the barrel is received and comprising a flange having a clearance bore adapted to be aligned with the through-bore of the annular collar for receiving an operating rod of the firearm therethrough, and a second clamp face, at least a portion of the second clamp face comprising a second oblique portion extending in an oblique direction with respect to the longitudinal axis of the barrel;

wherein at least a portion of the second oblique portion engages at least a portion of the first oblique portion as the mounting plate and annular collar are moved into engagement to adjust a position of the mounting plate so that as the mounting plate is moved toward the receiver a clamping force applied against the barrel extension is substantially aligned with a central axis of the barrel of the firearm.

* * * * *